United States Patent [19]

Langen et al.

[11] Patent Number: 4,688,372

[45] Date of Patent: Aug. 25, 1987

[54] LOAD COMPACTING MECHANISM FOR CARTON LOADING MACHINE

[75] Inventors: Marinus J. M. Langen, Toronto; Peter Guttinger, Rexdale, both of Canada

[73] Assignee: H. J. Langen & Sons Limited, Mississauga, Canada

[21] Appl. No.: 881,452

[22] Filed: Jul. 2, 1986

[51] Int. Cl.[4] ..... B65B 63/02

[52] U.S. Cl. ..... 53/529; 53/439; 100/151

[58] Field of Search ..... 53/529, 252, 438, 439; 100/151

[56] References Cited

U.S. PATENT DOCUMENTS

| | | | |
|---|---|---|---|
| 3,371,689 | 3/1968 | Carruthers | 53/529 X |
| 3,879,920 | 4/1975 | Langen | 53/252 X |
| 4,526,564 | 7/1985 | Hughes | 53/252 X |
| 4,553,659 | 11/1985 | Reim et al. | 53/252 X |
| 4,578,927 | 4/1986 | Scarpa et al. | 53/252 X |

FOREIGN PATENT DOCUMENTS

| | | | |
|---|---|---|---|
| 503445 | 6/1954 | Canada | 53/529 |

*Primary Examiner*—James F. Coan

*Attorney, Agent, or Firm*—Fetherstonhaugh & Co.

[57] ABSTRACT

A load compactor for compacting compressible loads of a carton loading machine is provided with compactor members which reciprocate vertically and are located directly above the load as it is driven through the loading station. The compactor members are mounted on a compactor conveyor which consists of a pair of endless chains. A plurality of carriers are mounted on the endless chains at spaced intervals. Carriages are slidably mounted on each carrier and have a compactor head at their lower end which bears against the compressible load. A guide track is provided for guiding the movement of the carriages toward and away from the load. The guide track has a forward run which is vertically spaced from its return run so that the heads of the compactors are vertically spaced from one another during the forward run and the return run and overlap one another to achieve a compact lateral configuration. The guide rails also include an elevator rail which extends along the forward run and an elevator mechanism for elevating the elevator rail so as to raise the compacting heads out of engagement with their associated load to clear a jam or the like.

5 Claims, 4 Drawing Figures

LOAD COMPACTING MECHANISM FOR CARTON LOADING MACHINE

Figure 1:
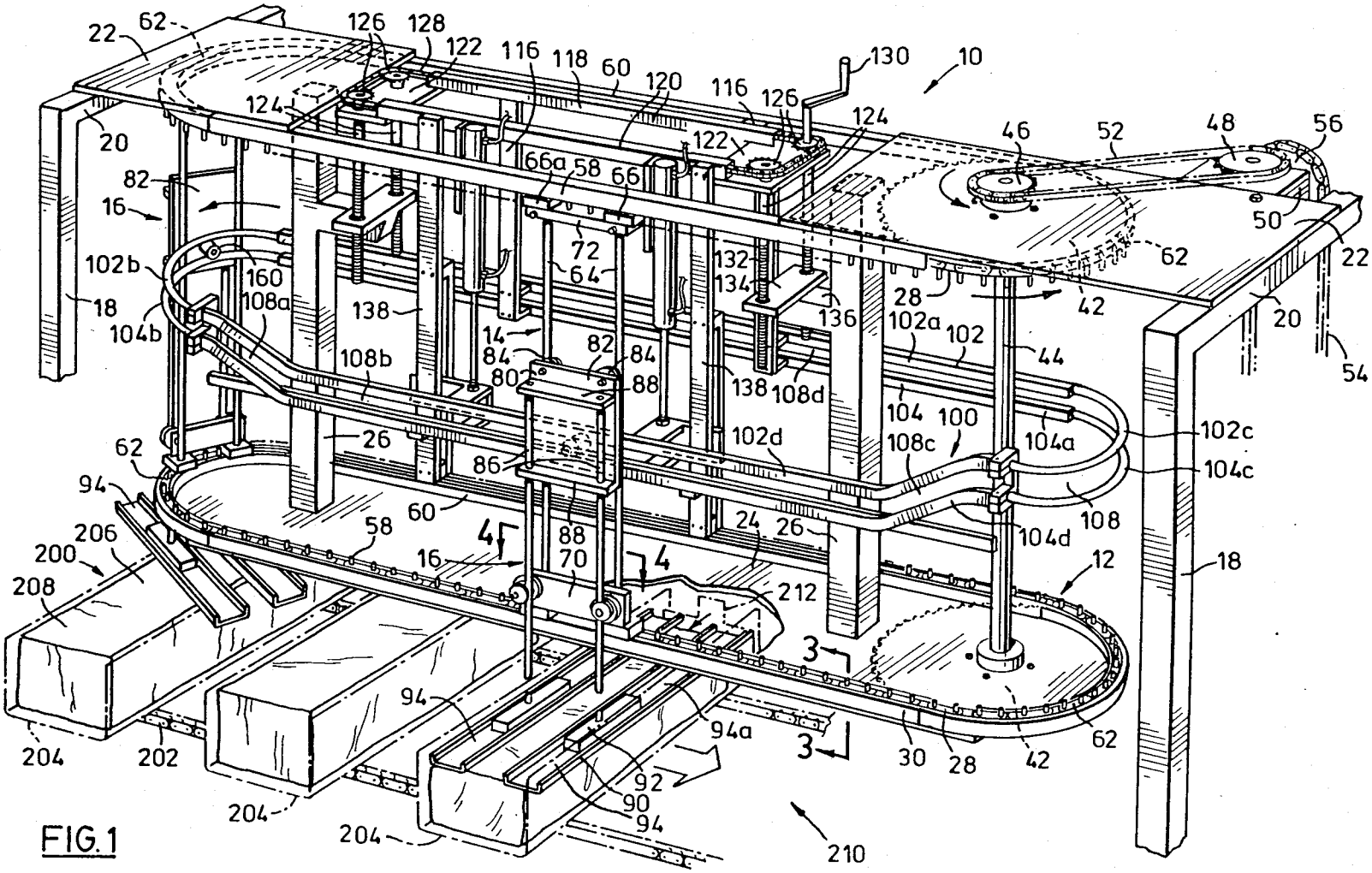

This invention relates to load compactors. In particular, this invention relates to a load compactor for use in association with a carton loading machine for end loading cartons.

PRIOR ART

Carton loading machines such as that described in U.S. Pat. No. 3,879,920 dated Apr. 29, 1975 and assigned to H. J. Langen & Sons Limited, the assignee of the present application. Machines of this type are suitable for use in loading a wide variety of products into cartons. Difficulty has, however, been experienced in compacting a load before it is transferred into a carton. Many products such as paper tissue and napkins are very bulky when arranged in a stack and are normally compressed in the carton in which they are sold.

In one form of compacting device previously proposed, the compacting members are mounted on lever arms which project laterally from a horizontally oriented conveyor which includes a forward run which is laterally spaced from the forward run of the carton loading machine. One such mechanism of this type is manufactured by H. J. Langen & Sons Limited and identified as a B-1 Auto Load Product Top Compressor No. 222. This mechanism has a substantial lateral extent and it effectively increases the width of the carton loading machine with the result that the carton loading machine with the Auto Load Product Top Compressor attached requires greater floor space than does the carton loading machine itself. Furthermore, difficulty is experienced in attempting to remove a product which becomes jammed in the receptacles because as a result of the increased width, it is difficult to gain access to the loaded receptacles.

The load compactor of the present invention is arranged substantially directly above the transfer station and has a lateral width which is substantially less than that of the load compactors previously available.

It is an object of the present invention to provide a load compactor for use in association with a carton loading machine, the load compactor having a lateral width which does not add significantly to the width of the carton loading machine.

In order to minimize the lateral width of the carton loading machine, the compactor members of the load compactor of the present invention are arranged to reciprocate vertically between the compacting position and the retracted position.

It is a further object of the present invention to provide a load compactor in which the compactor members are slidably mounted for vertical movement between the compacting position and the raised position.

In order to obtain a compact configuration while providing compactor heads which are of a substantial length, the return run of the guide rails which control the position of the compactor is arranged to extend in a plane which is disposed above the plane of the guide rail of the forward run so that the portions of the compactor heads which extend inwardly of the guide track from the return run will be spaced above and will overlap the portions of the head which extend inwardly of the guide track from the forward run.

It is an object of the present invention to ensure that the compactor heads of the compactor members which are positioned along the return run are vertically spaced above the compactor heads which are positioned along the forward run.

In order to facilitate the clearing of a jam or the removal of a load from a receptacle travelling through the loading station, an elevator mechanism is provided for elevating the compactors which are located along the forward run to a height which raises them clear of their associated receptacle.

It is a still further object of the present invention to provide an elevator mechanism for elevating the compactors which are located along the forward run out of their associated receptacles to facilitate the clearing of a load from the receptacles located in the transfer station.

In load compactor machines, the compacting height of the load may vary considerably from one package to another and the load compactor of the present invention provides a simple and efficient mechanism which permits adjustment of the compacting height of the compactor travelling through the transfer station.

It is yet another object of the present invention to provide for the simple adjustment of the compacting height of the compactor heads travelling through the transfer station.

SUMMARY OF INVENTION

According to one aspect of the present invention, there is provided a load compactor for use in association with a carton loader of the type having a plurality of load receptacles mounted on a load transporter conveyor for movement along a first plane through a load transfer station in which the load is transferred from the receptacle to a carton or the like, each receptacle having an open upper end, said load compactor comprising a compactor conveyor having a forward run which is coextensive with said load transporter conveyor through said transfer station and a return run which is spaced from said forward run, a plurality of carriers mounted on said compactor conveyor at spaced intervals corresponding to the spacing of the loading receptacles, so as to be associated with a receptacle during passage along said forward run, compactor means slidably mounted on each carrier for movement in a direction perpendicular to said first plane between a retracted position disposed outwardly from and an extended position disposed within the open upper end of its associated loading receptacle during travel through said transfer station, means for moving the compactor means to and fro between said retracted position and said extended position to permit initial alignment of each compactor with its associated loading receptacle and subsequent extension toward and retraction from its associated loading receptacle during movement through said transfer station.

Figure 2:
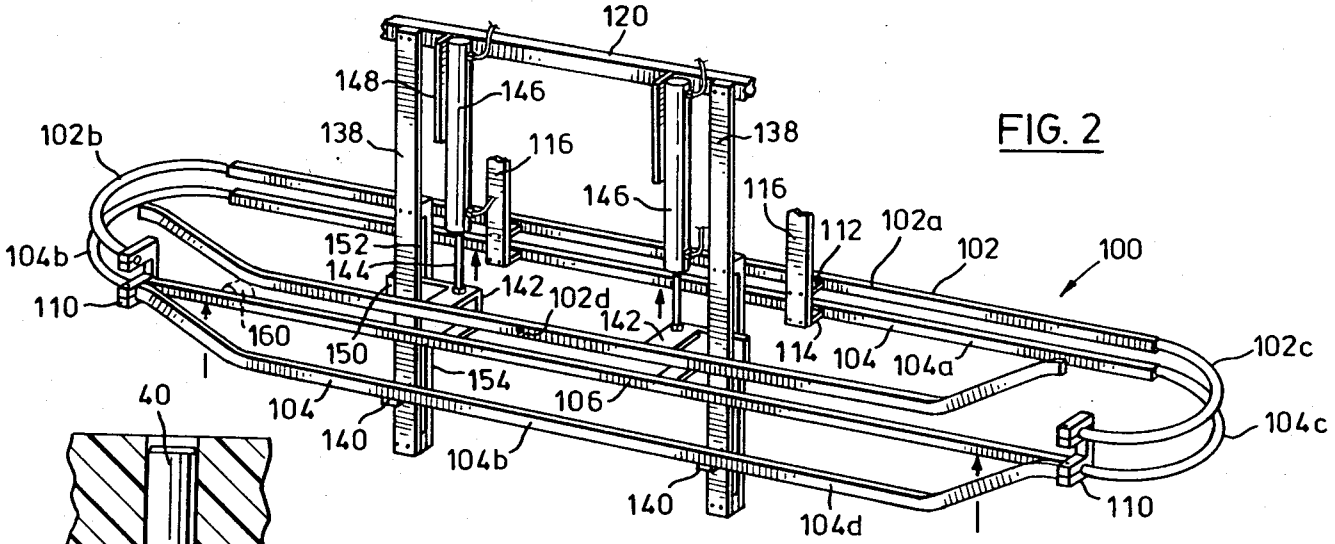
Figure 3:
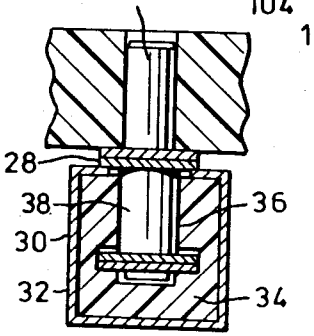
Figure 4:
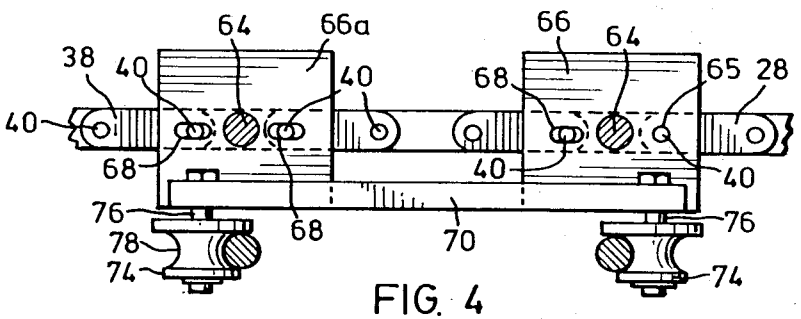

The invention will be more clearly understood after reference to the following detailed specification read in conjunction with the drawings wherein;

FIG. 1 is a pictorial view of a compactor constructed in accordance with an embodiment of the present invention, FIG. 2 is a pictorial view of the guide track of the compactor of FIG. 1 showing the elevator rail in its raised position, FIG. 3 is a sectional view taken through the conveyor of FIG. 1 along the line 3—3, FIG. 4 is a sectional view through the compactor taken along the line 4—4 of FIG. 1.

With reference to FIG. 1 of the drawings, the reference numeral 10 refers generally to a compactor assembly which comprises a frame 8, a compactor conveyor 12 on which a plurality of carriers 14 are mounted and compactor members 16 which are mounted on the carriers 14.

The frame 8 includes a plurality of upright posts 18, only two of which are shown, and horizontal beams 20. Top plates 22 are supported by the horizontal beams 20 and extend laterally inwardly therefrom. A bottom plate 24 is located directly below the top plates 22 and is supported by support posts 26.

The compactor conveyor 12 has a pair of endless chains 28 which are mounted for movement along chain guide tracks 30 which are supported by the top plates 22 and by the bottom plate 24. As shown in FIG. 3 of the drawings, the chain guide track 30 comprises an outer metal housing 32 within which a body 34 of a low friction plastics material is located. A chain receiving channel 36 is formed in the body of plastic material 34 and opens outwardly therefrom. The channel 36 is shaped and proportioned to receive the link portions 38 of a chain which will be retained therein against all movement except movement longitudinally of the channel 36. The chain guide track 30 is made in a plurality of sections which can be separated from one another so as to facilitate the positioning of the endless chain in the chain receiving channel 36. Each link of the chain 38 has two short shafts 40 projecting therefrom.

The chains 28 are driven by drive sprockets 42 which are mounted on a drive shaft 44. A further drive sprocket 46 is connected to the output drive sprocket 48 of a gearbox 50 by means of a drive chain 52. A power input drive chain 54 serves to connect a power source (not shown) to the input drive sprocket 56 of the gearbox 50.

The compactor conveyor 12 has a forward run portion 58 and a return run portion 60, the return run portion 60 includes direction reversal curved portions 62. The forward run 58 and return run 60 of the upper endless chain 28 are located directly above the forward run 58 and return run 60 of the lower chain 28.

A plurality of carriers 14 are mounted at spaced intervals along the length of the chains 28 and extend vertically therebetween. Each of the carriers 14 comprises a pair of spaced parallel guide rods 64. As shown in FIG. 4 of the drawings, the lower ends of the rods 64 are mounted in support pads 66 and 66*a*. The support pad 66 has one circular passage 65 formed therein to receive a short shaft 40 in a close fitting relationship. An elongated slot 68 is also formed in the support pad 66 to receive the next adjacent short shaft 40. A pair of elongated slots 68 is formed in the support pad 66*a* to receive the short shafts 40 of the chain 28. The slots 68 serve to permit the carriers 14 to negotiate the curvature of the direction reversal portions of the guide track. A bridging plate 70 is connected to and extends between the support pads 66 and 66*a*. A bridging plate 72 connects the upper ends of the shafts 64. A second pair of support pads 66 and 66a are mounted on the bridging plate 72 and are secured to the short shafts 40 of the upper chain in the same manner that the corresponding pads are secured to the lower chain 28.

The bridging plate 70 has a pair of rollers 74. Each roller 74 has an arcuate shaped groove 78 formed thereon.

The compactor member 16 is mounted for vertical movement along the carrier 14. The compactor member 15 comprises a carriage 80 which consists of a base plate 82 which has a pair of roller members 84 mounted on its inner face. The rollers 84 each have a grooved surface shaped to run along the guide rods 64. A pair of legs 86 are mounted on flanges 88 which project from the base plate 80. As shown in FIG. 4, the legs 86 pass between rollers 74 of the bridge plate 70 and are received in the grooves 78 of the rollers 74 in a close fitting relationship. A compactor head 90 is located at the lower end of each leg 60. The compactor head 90 includes a mounting block 92 which is secured directly to the lower end of each leg 86 and an elongated channel shaped member 94 which is releaseably secured to the block 92. The elongated channel members 94 each have an inner end portion 94*a* which extends laterally inwardly of the endless chain. This is important to ensure that the compactor head can extend over the full length of the load which is to be compacted. This extension, however, creates a problem because of the limited space provided between the forward and return lengths of the compactor conveyor.

The guide track 100 which serves to control the movement of the carriages 16 will not be described with reference to FIGS. 1 and 2 of the drawings.

The guide track 100 comprises a top rail 102, a bottom rail 104 and an elevator rail 106. When the top rail 102 and bottom rail 104 are located in the normal operating position shown in FIG. 1 of the drawings, a guide passage 108 is formed therebetween which is coextensive with the compactor conveyor.

The top guide rail 102 includes a straight return portion 102*a*, a pair of direction reversal portions 102*b* and 102*c* and a forward run portion 102*d*. The bottom rail 104 includes a straight return length portion 104*a*, a pair of direction reversal portions 104*b* and 104*c* and a forward run portion 104*d*. A pair of brackets 110 serve to connect the ends of the curved portions 102*b* and 104*b* and 102*c* and 104*c*. The brackets 110 are also connected to opposite ends of the forward run portion 104*d*. The brackets 110 serve to retain the guide rails 102 and 104 in a spaced relationship. The return length portions 102*a* and 104*a* are also mounted on support plates 112 and 114 respectively which are secured to hanger straps 116. The support plates 112 and hanger straps 116 serve to maintain the required spaced relationship between the top and bottom rails 102. The position of the guide track 100 relative to the frame 8 can be adjusted so as to vary the extent of compaction of the goods. This height adjustment is achieved by means of a subframe 118. The subframe 118 comprises a pair of horizontal beam members 120, opposite ends of which are mounted on plates 122. The upper ends of the hanger straps 116 are mounted on one of the beams 120. Four shafts 124 have their upper ends mounted for rotation in the plates 122 and extend downwardly therefrom. Sprockets 126 are mounted at the upper ends of the shafts 124 and a drive chain 128 extends around each of the sprockets 126. A crank handle 130 is connected to the upper end of one of the shafts 124 such that by manually rotating the crank handle 130, each of the shafts 124 can be rotatably driven. The lower ends of each shaft 124 include a threaded portion 132 which is threadedly located in a support plate 134 which is mounted on an arm 136 which extends from the support posts 26. Thus, it will be seen that by rotating the crank arm 32, the rotation of the shafts 124 in the threaded passages provided in the support plates 134 will cause the subframe 118 to rise or fall relative to the frame 8 depending upon the direction of rotation of the crank 130. A further pair of hanger straps 138 have their upper ends mounted on the other beam 120 of the subframe 118 and extend downwardly therefrom. A lug 140 projects outwardly from each hanger strap 138 adjacent the lower end thereof and is secured to the forward run portion 104*b* of the lower rail 104.

The portion 102*d* of the top rail 102 and the elevator rail 106 are each mounted on brackets 142. The brackets 142 are mounted on a ram 144 of a pneumatic cylinder 146 which is secured by means of a mounting plate 148 to the beam 120. The brackets 142 each have a laterally extending lug 150 slidably mounted in a channel 152 which is formed between hanger strap 138 and a retainer bar 154 which is mounted on the strap 138.

To adjust the height of the guide track 100, it is merely necessary to turn the crank handle 130. By operating the crank handle 130, the subframe 118 can be raised or lowered as required and will take with it, the various hangers including the pneumatic cylinders 146 which support the guide track.

Each of the compactor members 16 has a follower roller 160 mounted on the back face of its base plate 82 and these follower rollers are located in the guide passage 108 to follow the contour of the guide passage 108. It will be noted that when the guide rails are located in the operable position shown in FIG. 1 of the drawings, the guide track 108 which extends along the forward run of the compactor conveyor includes an entrance ramp 108*a* which is downwardly inclined to a horizontal portion 108*b* which in turn extends to an upwardly inclined retraction portion 108*c*. It will be noted that the plane along which the horizontal portion 108*b* extends is located at a level which is a substantial distance below the level of the horizontal plane along which the portion 108*d* extends when acting as the return guide passage. This separation of the plane of the return portion of the guide track and the plane of the forward run portion of the guide track serves to ensure that the inwardly extending extensions 94*a* of the elongated channels 94 of the compactor heads do not interfere with one another because they travel in opposite directions and as they rotate about the ends of the compactor conveyor.

Occasionally it may become necessary to remove the compactor heads from the receptacles while the receptacles are located in the load transfer station. This can be achieved by activating the pneumatic cylinders 146. By activating the pneumatic cylinders 146, their associated rams 144 can be raised thereby raising the brackets 142 which in turn raise the top rail section 102*d* and the elevator rail 106. By raising the elevator rail 106, all of the cam followers 160 which have been previously resting on the bottom rail portion 104*d* can be elevated to the position shown in FIG. 2 of the drawings in which the elevator rail 106 is aligned with the portions 104*b* and 104*c*. This raising of the elevator shaft 104 causes the compactor members which are in contact therewith to be raised out of compacting engagement with the load.

In use, the load compactor 10 is positioned so that its forward run is located directly above the transport conveyor 200 of a carton loading machine such as that described in U.S. Pat. No. 3,879,920 which has a conveyor 202 upon which a plurality of receptacles 204 are mounted at spaced intervals. A load unit 206 is located in each receptacle 204. Each receptacle 204 has an open upper end 208. The compactor carriers 14 are spaced along the compactor conveyor 12 at intervals corresponding to the spacing of the receptacles 204. In use, the compactor conveyor is driven at a speed which matches the speed of the load transporting conveyor so that the compactor heads can be aligned one with each load receptacle passing through the load transfer station which is generally identified by the reference numeral 210. As each carrier 14 is driven around the curved end of the guide track at the entrance to the transfer station, the elongated channel members are rotated to a position in which they are substantially aligned with the receptacle 204 which they are to be associated with such that by the time the follower 160 arrives at the entrance ramp 108*a* of the guide passage 108, the compactor heads are substantially aligned with the open end of their associated receptacle 204 with the result that further movement along the entrance ramp 108 causes the compactor head to move downwardly into the open end of the receptacle 204 to compact the load to the required height for discharge into a carton. A conventional pusher plate 212 is provided for pushing the compacted load out of the receptacle 204 during passage through the load transfer station and it will be noted that the channel members 94 are spaced from one another a sufficient distance to permit the centrally located upwardly extending projection of the pusher plate to extend therebetween.

From the foregoing it will be apparent that the load compactor of the present invention is relatively narrow and this is derived from the fact that the compacting plungers are arranged to reciprocate vertically on the vertically oriented compactor conveyor. This narrow structure is possible because of a number of factors, an important one of which is that the guide track which controls the position of the compactor has a forward run plane which is vertically spaced from the return run plane with the result that the compactor heads travelling therealong can overlap one another without coming in contact with one another.

A further important feature is that the height of the guide track relative to its support frame can be easily adjusted so that the extent to which the load is to be compacted can be controlled with ease.

It will also be apparent that the provision of the elevator rail mechanism greatly facilitates the temporary removal of the compactor heads from their associated receptacle to facilitate the removal of a jammed or damaged load.

From the foregoing it will be apparent that the present invention provides a simple and efficient form of load compactor for use in association with a carton loading machine.

We claim:

1. A load compactor for use in association with a carton loader of the type having a plurality of load receptacles mounted on a load transporter conveyor for movement along a first plane through a load transfer station in which the load is transferred from the receptacle to a carton or the like, each receptacle having an open upper end, said load compactor comprising;

(a) a compactor conveyor which extends in an endless path and which includes a forward run which is coextensive with said load transporter conveyor through said transfer station, a first direction reversal run which extends to a return run which is spaced from said forward run, and a second direction reversal run extending from the return to the forward runs, (b) a plurality of carriers mounted on said compactor conveyor at spaced intervals corresponding to the spacing of the loading receptacles, so as to be associated with a receptacle during passage along said forward run, (c) compactor means slidably mounted on each carrier for movement in a direction perpendicular to said first plane between a retracted position, an extended position and an elevated position such that when the compactor means is in the retracted position, it is retracted from its associated receptacle and when it is in the extended position it projects into its associated receptacle and when in the elevated position it is elevated above its retracted position, each compactor means comprising a plunger having a head which extends transversely of said path and has an inner end portion which projects laterally inwardly and an outer end portion which projects laterally outwardly from the forward, return and direction reversal runs as it is driven therealong, (d) means for moving the compactor means between said retracted position and said extended position to permit initial alignment of each compactor with its associated loading receptacle and subsequent extension toward and retraction from its associated loading receptacle during movement through said transfer station, said means for moving said compactor means serving to locate the inner end portions of the heads of the compactor means travelling along the return run in an overlapping relationship with the inner end portion of the heads travelling along the forward run.

2. A compactor as claimed in claim 1, wherein said compactor conveyor includes first direction reversal means at a first end thereof which is downwardly inclined for reversing the direction of movement of the return run while lowering the head portions as they move toward the forward run and second direction reversal means at the second end of the forward run for reversing the direction of the forward run while raising the head portions as they move toward the return run, said means for moving the compactor means being operable to progressively lower the head portion of the compactor means to the retracted position during reversal at said first end until the head portion of each plunger is substantially aligned with its associated receptacle and then to retract the head portion of the compactor means from its associated receptacle to return the compactor means to the retracted position before movement along the second direction reversal means, and to progressively raise the head portion to the elevated position so as to provide clearance between the plunger heads during movement along the complete length of the path of travel of said compacting conveyor.

3. A load compactor as claimed in claim 1, wherein said means for moving said compactor means comprises an elevator rail co-extensive with said forward run and elevator means for elevating said elevator rail to move the compactor means to said retracted position at any time during passage along said forward run in response to a control signal so as to facilitate clearing of a misaligned load, to prevent over-compaction or to respond to a safety emergency.

4. In a carton loading machine for end loading cartons in which a plurality of loading receptacles are mounted at spaced intervals along the length of a load transporting conveyor for movement in a first horizontal plane through a load transfer station in which the load which is located in each receptacle is transferred into a carton, the improvement of;

(a) a compactor frame, (b) a compactor conveyor mounted on said compactor frame and comprising; a pair of endless chains mounted one above the other in a spaced parallel relationship for movement with respect to said frame along an endless path which includes a vertically oriented forward run disposed above and coextensive with the load transporting conveyor through the transfer station, (c) a plurality of carriers mounted on said endless chains at spaced intervals corresponding to the spacing of the load receptacles so as to be aligned with an associated one of said loading receptacle during passage through said transfer station, each of said carriers comprising a pair of spaced parallel carrier guide rails mounted on and extending vertically between said endless chains for movement therewith, (d) compactor means for compacting the load during transfer comprising;

(i) a carriage slidably mounted on each pair of carrier guide rails for vertical movement with respect to said first horizontal plane so as to be movable toward and away from said first horizontal plane, (ii) a pair of legs each having a proximal end mounted on said carriage member and a distal end projecting toward said first horizontal plane, (iii) a compacting head at the end of each leg, each compacting head extending transversely of said endless path and including an inner end portion which extends laterally inwardly of the endless path, (e) a guide track for guiding the movement of said carriage member toward and away from said first horizontal plane as said compactor conveyor is driven continuously along said endless path, said guide track being coextensive with and extending parallel to said endless path and located between said endless chains, said guide track having a forward run which includes an entrance ramp which is downwardly inclined toward said first horizontal plane, a horizontal portion which extends in a second horizontal plane and a retracting ramp which is upwardly inclined away from said second horizontal plane and a return portion which extends in a third horizontal plane which is spaced above said second horizontal plane, (f) height adjustment means mounting said guide track for movement with respect to said frame for adjusting the height of said guide track above said first horizontal plane, (g) the forward run of the guide track comprising a top rail length and a bottom rail length, (h) an elevator rail extending horizontally along the forward run of said guide track, (i) elevator means mounted on said frame and engaging said elevator rail and said top run, said elevator means being operable to move the elevator rail and top rail between a first position in which the elevator rail extends in or below the plane of the horizontal portion of the forward run of the bottom rail and a second position in which it extends horizontally between the ends of the return portion of the bottom rail in said third horizontal plane, (j) follower means on each carriage member engaging said guide track for movement along said guide track to cause the carriage members and their associated compression heads to move into and out of a position compressing the load in their associated receptacle during passage through the transfer station, the follower members which are located along the forward run also being movable to an elevated position by engagement with said elevator rail when it is raised to its second position to raise the compression heads out of their associated receptacles.

5. A load compactor for use in association with a carton loader of the type having a plurality of load receptacles mounted on a load transporter conveyor for movement along a first plane through a load transfer station in which the load is transferred from the receptacle to a carton or the like, each receptacle having an open upper end, said load compactor comprising;

(a) a compactor conveyor having a forward run which is coextensive with said load transporter conveyor through said transfer station and a return run which is disposed opposite and spaced from said forward run, and first and second direction reversal portion at opposite ends of said forward run for connecting the forward and return runs, (b) a plurality of carriers mounted on said compactor conveyor at spaced intervals corresponding to the spacing of the loading receptacles, so as to be associated with a receptacle during passage along said forward run, (c) compactor means slidably mounted on each carrier for movement in a direction perpendicular to said first plane, each compactor means comprising a plunger having a head which has an inner end portion which projects inwardly of the run on which its associated compactor is located toward the opposite run, and an outer end portion which projects outwardly from the run on which its associated compactor is located, (d) guide means for moving the compactor means toward and away from said first plane as they are driven along, said guide means being arranged to locate said head portion in a retracted position spaced from the open upper end of its associated receptacle at the beginning of the forward runs and serving to lower the head portion into the open end to compact the load during travel along a major portion of the forward run and serving to return the head to the retracted position before the end of the forward run and serving to progressively raise the head from the retracted position to an elevated position during travel along the first reversal to elevate and maintain the head portion in an elevated position during travel along the return portion and then serving to progressively lower the head from the elevated position to the retracted position during travel along the second reversal, whereby the inner end portions of the heads are vertically spaced from one another at all points along their path of travel where their paths cross one another.

* * * * *